United States Patent [19]

Myers

[11] 4,226,192

[45] Oct. 7, 1980

[54] PALLET FOR TRANSPORTING AND DISPLAYING MERCHANDISE

[76] Inventor: Douglas R. Myers, 5348 Norbeck Rd., Rockville, Md. 20853

[21] Appl. No.: 1,385

[22] Filed: Jan. 5, 1979

[51] Int. Cl.[3] ..... B65D 19/18

[52] U.S. Cl. ..... 108/53.1; 108/53.3; 108/55.3; 206/503; 206/511

[58] Field of Search ..... 108/53.1, 52.1, 533, 108/51.1, 901, 55.3, 53.5, 55.1, 56.1, 57.1; 211/126; 206/386, 599, 600, 503, 505, 507, 511; 108/91

[56] References Cited

U.S. PATENT DOCUMENTS

| | | | |
|---|---|---|---|
| 1,010,801 | 12/1911 | Rapp | 108/53.5 X |
| 1,867,738 | 7/1932 | Fraser | 211/126 |
| 2,584,762 | 2/1952 | Vossenberg | 108/52.1 X |
| 3,403,788 | 10/1968 | Kreeger | 206/507 X |
| 3,848,546 | 11/1974 | Lawlor | 108/53.1 X |
| 3,866,788 | 2/1975 | Smit | 211/126 X |
| 4,106,624 | 8/1978 | Thurman | 206/507 |

FOREIGN PATENT DOCUMENTS

| | | | |
|---|---|---|---|
| 339162 | 12/1930 | United Kingdom | 108/91 |

*Primary Examiner*—William E. Lyddane
*Attorney, Agent, or Firm*—A. W. Breiner

[57] ABSTRACT

Pallets of substantially unitary construction for transporting materials with a handtruck having a front carrying blade, comprising a deck, at least two upwardly extending sides and legs at each corner of the deck extending downwardly approximately one-half to an inch and a half from said deck. The deck preferably contains openings for hand placement for removing merchandise from the pallets. The pallets permit the handling of a plurality of cases containing merchandise stacked one on the other with a handtruck without concern of tipping of the plurality of cases. Additionally, merchandise can be displayed in the pallets without detraction from the merchandise on display.

6 Claims, 3 Drawing Figures

PALLET FOR TRANSPORTING AND DISPLAYING MERCHANDISE

FIELD OF INVENTION AND BACKGROUND

This invention is directed to plastic pallets for material transport. More particularly, the invention relates to substantially unitary plastic pallets designed to receive and carry a single case or carton of merchandise. The construction of the pallets permits the stacking of cases of merchandise one upon the other without interference therewith and without interference in the viewing of writing or the like on the cases or cartons of merchandise. The pallet is designed with short legs so that the first pallet of the stack is resting slightly above the floor or ground to permit the blade of a handtruck to be pushed under the pallet. The pallets and the cases can, therefore, be lifted by the handtruck without possibility of the stack of merchandise slipping and/or toppling in the course of positioning of the blade of the handtruck.

Pallets for material handling are commonly employed in commerce to transport virtually all types of merchandise from one location to another. However, most pallets heretofore used are designed to carry a plurality of cases or cartons or barrels of merchandise and the pallets loaded with the merchandise are handled with forklift trucks or the like. Normally, the merchandise is carried to the pallets for shipment with a handtruck. Additionally, after the pallets with the merchandise are settled at a particular location of use, a number of cases or cartons are transported away from the pallet for storage or to the place of sale or use by means of a handtruck. Normally, a plurality of cases are placed one upon another on the floor next to the pallet and thereafter tipped away from the handtruck operator so as to position the blade of the handtruck under the lowermost case. The cartons, as a unit, are thereafter tipped back toward the user onto the handtruck for transport. At times, particularly when the merchandise is displayed in a half-case, that is where the carton containing the merchandise only comprises a bottom and half sides, there is a danger of the cases of merchandise slipping and toppling to the floor. When this happens, the merchandise can be damaged and, additionally, damage can be caused to goods or the like in the area surrounding the mishap. There is always a consumption of time and energy in collecting and recasing the merchandise.

OBJECT AND GENERAL DESCRIPTION OF INVENTION

Accordingly, the primary object of the present invention is to provide a pallet for receiving and retaining a single case or carton of merchandise which permits the stacking of a plurality of the pallets each with a case or carton of merchandise one upon another without interference by the pallets with the stacking and which permits the positioning of the blade of the handtruck under the lowermost pallet without need for tipping of the cases of merchandise. The primary object of the invention is accomplished by molding a plastic pallet comprising a unitary deck having at least two sides joined to the deck and legs or "feet" at each corner of the pallet. The "feet" are to be at most one-half to one and a half inches high. The sides are to be less than about five inches and preferably from about one to three inches. A pallet so designed will permit the passage of the blade of a handtruck under the lowermost case or carton of a stack from the sides thereof without tipping of the carton. Moreover, the sides will retain the carton on the pallet without obstructing the view of labeling or the like on the carton.

DETAILED DESCRIPTION AND DRAWING

Figure 1:
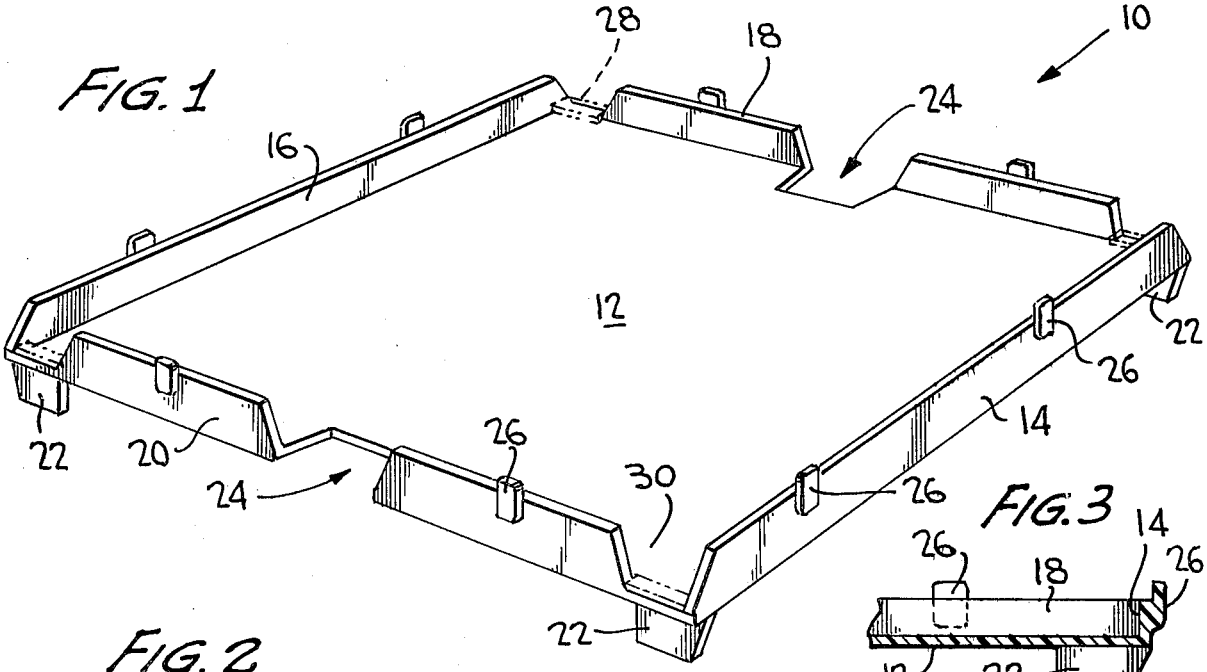
Figure 2:
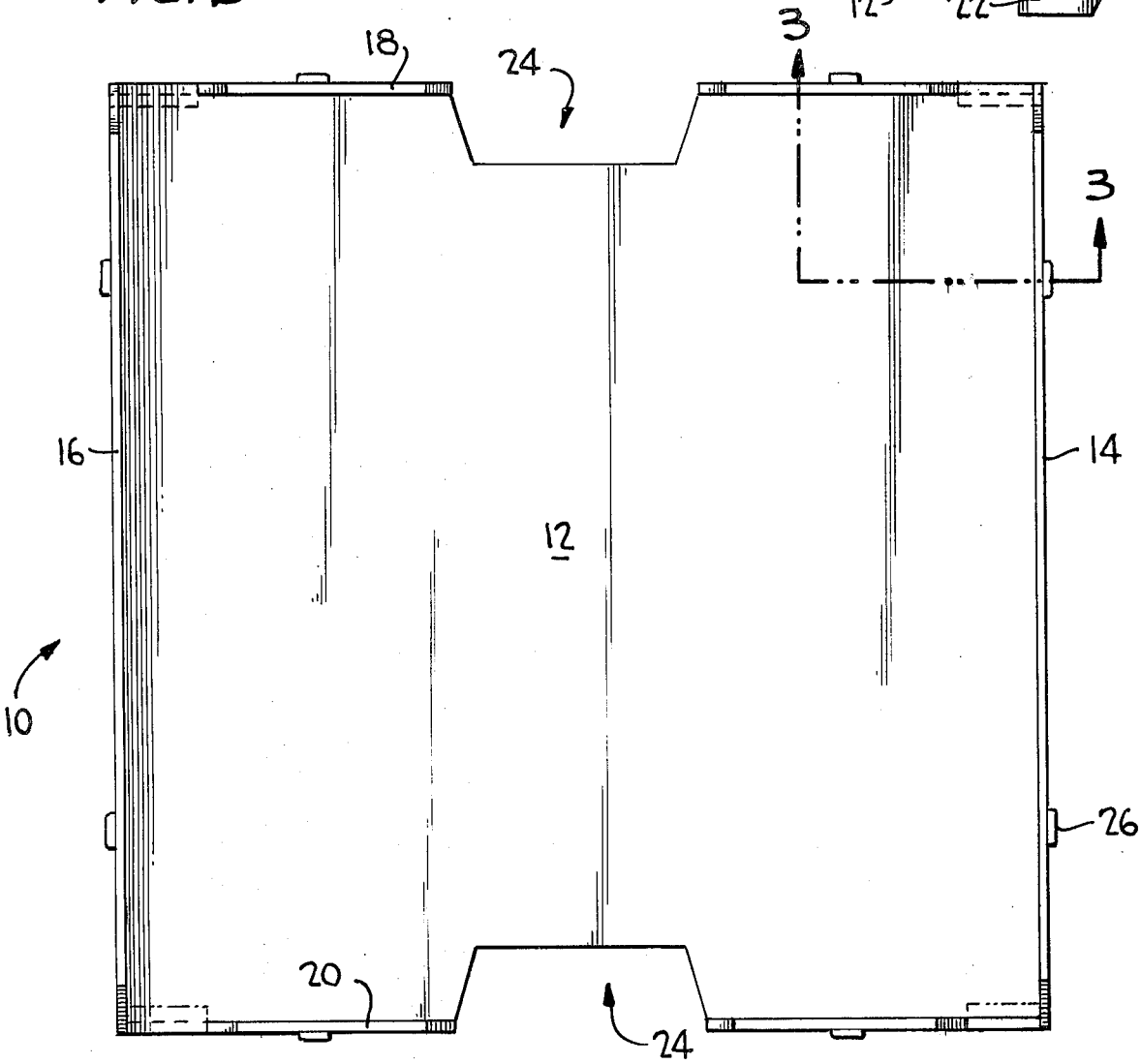

Having described the invention in general terms, a specific embodiment will be described with reference to the drawing wherein FIG. 1 is a perspective view of the pallet;

FIG. 2 is a plan view of the pallet; and

Figure 3:
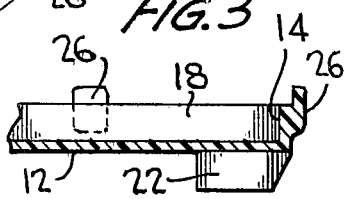

FIG. 3 is a sectional view taken along lines 3—3 of FIG. 2. Referring to the drawing wherein like elements are identified with like numerals, FIG. 1 shows a preferred construction of pallet 10 having a deck 12 and sides 14, 16, 18, and 20. Legs or feet 22 are at each corner of the pallet. The feet extend downward only approximately a half-inch to an inch and a half. Accordingly, the feet can be relatively thin and still have the essential strength.

As shown in the drawing, sides 18 and 20 are notched at 24. The notches extend into the deck 12 as best shown in FIG. 2. The notches permit the picking up of a case or carton from the pallet by the bottom of the case or carton, for more convenient handling of the merchandise.

As a preferred embodiment, the pallet will have either tabs 26 arranged around and on the outside of the sides of the pallet to facilitate stacking of a plurality of pallets without slipping or sliding of the pallets. Alternatively, the pallets can have, as shown in the figures in phantom lines, a raised or recessed area 28 and a cutaway 30 to position the feet of the pallets when the pallets are stacked empty.

In the preferred embodiment shown, the feet 22 are thin and elongated and tapered away from the ends of the pallet. This design provides slightly more clearance and increased strength. Additionally, the thin and elongated feet permit the pallets to be lowered to the ground while a handtruck is moving which exerts substantial force on the feet. With the design, the force or pressure is absorbed by the feet in a lengthwise direction which is where the strength lies. The use of the elongated feet, however, may prevent the entrance of the blade of the handtruck from other than two directions. If it is desirable to have the blade of the handtruck enter from any of the four directions, the length of sides 18 and 20 can be slightly increased with respect to sides 14 and 16. The feet preferably will be from about one-half inch to three-quarter inch high, only just high enough to allow the handtruck blade to slide under the pallet. The pallets will be sized to mate the cartons being carried. Normally, however, the pallets will be slightly longer than the width of a handtruck blade, i.e., from 14 to 20 inches wide.

The pallets of this invention, which preferably are injection molded, are inexpensive in mass production. The pallets are particularly advantageous for carrying of merchandise for example cartons of paint in half-gallons and/or gallons, which is normally packaged with the top half of the containers, exposed for display purposes. Obviously, however, the pallets can be used with any merchandise where transport with a handtruck is essential. Preferably, each carton or case to be transported or displayed will be positioned on a separate pallet. However, substantial benefit is obtained where only the bottom or lowermost case is positioned on a pallet, with the other cartons or cases being stacked as is conventional. The use of the pallet prevents the usual problems associated with carrying of stacked cartons, without interfering with the display of labels or other information contained on the cartons.

In the manufacture of the pallets, any of the conventional polymers, such as the polyalkylenes and condensation polymers, can be employed. If desired, the plastic can be filled, for example with glass fiber, to provide increased strength.

As will be apparent to one skilled in the art, various modifications can be made in the invention without departing from the inventive concept of the present application. Being obvious modifications, they are to be included within the scope of the present invention.

It is claimed:

1. A pallet for receiving and stacking products for storage, shipping, and advertising, said pallet comprising a generally rectangular base, product retaining sides along all edges of said base and extending upwardly therefrom and including first and second retaining sides, feet extending downwardly from about one-half inch to one and one-half inches from said base for supporting said base upon a supporting surface for receiving therebeneath a lifting element, said feet being elongated along two remote sides of said base and arranged in two pairs, the feet of each pair being elongated parallel to said first retaining side and lying in a common general plane, and said first retaining side being terminated at opposite ends thereof in spaced relation adjacent said second retaining sides to provide clearances for said feet, with said feet being spaced inwardly from one adjacent edge of said base a distance at least equal to the thickness of an adjacent one of said retaining sides and said base having a recess located adjacent each end of said first retaining sides to receive a foot of a like pallet stacked thereon, said rectangular base having a length on at least two opposite edges thereof between said feet sufficient to receive a handtruck, and said feet extend below said base a distance greater than the height of said retaining sides.

2. A pallet according to claim 1 wherein said feet are elongated normal to said retaining sides and are engageable with said retaining sides to effect automatic alignment of stacked pallets.

3. A pallet according to claim 1 wherein each of said retaining sides having a plurality of aligning tabs extending upwardly from an exterior surface thereof for engaging an exterior surface of a like retaining side of a next upper pallet.

4. A pallet according to claim 1 wherein said second retaining sides have free ends tapering upwardly away from said base, and each foot having a free end adjacent each second retaining side flaring upwardly towards said base, adjacent feet and second retaining side free ends being arranged in overlapping relation.

5. A pallet according to claim 1 wherein two opposite sides and said base have intermediate hand receiving recesses for facilitating grasping and lifting of a product on said pallet.

6. The pallet of claim 5 wherein said feet extend downwardly from about one-half to three-quarters of an inch.

* * * * *